US005394787A

United States Patent [19]

Fähnle et al.

[11] Patent Number: 5,394,787

[45] Date of Patent: Mar. 7, 1995

[54] MUFFLED HYDROSTATIC DISPLACEMENT MACHINE WITH RADIAL SEAL

[75] Inventors: Gerhard Fähnle; Günther Nagel, both of Steinheim, Germany

[73] Assignee: J. M. Voith GmbH, Heidenheim, Germany

[21] Appl. No.: 79,992

[22] Filed: Jun. 18, 1993

[30] Foreign Application Priority Data

Jun. 19, 1992 [DE] Germany ..... 42 20 028.8

[51] Int. Cl.[6] ..... F01B 1/06; F01B 13/06

[52] U.S. Cl. ..... 92/12.1; 91/497

[58] Field of Search ..... 92/72, 12.1; 91/491, 91/497, 494

[56] References Cited

U.S. PATENT DOCUMENTS 3,913,456 10/1975 Bosch ..... 91/497

5,081,907 1/1992 Nagel et al. ..... 91/497

FOREIGN PATENT DOCUMENTS 57-168069 10/1982 Japan ..... 91/491

*Primary Examiner*—Edward K. Look

*Assistant Examiner*—John Ryznic

*Attorney, Agent, or Firm*—Baker & Daniels

[57] ABSTRACT

A hydrostatic displacement machine has in a revolving cylinder block several displacement elements movable in a guideway and having a radial position during the rotation of the cylinder block determined by a nonrotating displacement ring. The displacement elements, viewed axially, are retained on the displacement ring by two retaining rings. The retaining rings feature relative to the displacement ring a radial seal. The axial seal of the retaining rings is effected in standstill, relative to the housing or housing lid, by way of spring elements, and during the pumping operation, by a contact force which is indirectly dependent on the operating pressure.

1 Claim, 1 Drawing Sheet

MUFFLED HYDROSTATIC DISPLACEMENT MACHINE WITH RADIAL SEAL

BACKGROUND OF THE INVENTION

The present invention relates to a muffled hydrostatic displacement machine.

A muffled hydrostatic displacement machine of this type is known from DE-OS 39 21 790. The core of this hydrostatic displacement machine consists in sealing—based on the displacement ring—the radially outer area relative to the radially inner area in such a way and having such a varying pressure act upon it that the noise level caused by the position of the displacement ring will be reduced.

The known conception, or design, has uniquely proved itself in conjunction with the basic idea—it is somewhat problematic only insofar as relatively close tolerances must be observed so as to avoid, because of the axially one-sided seal, an insufficient or excessive contact force. Insufficient contact pressure leads to a lacking sealing effect; excessive contact pressure entails problems in the adjustment or setting of the displacement ring, particularly with low adjustment pressures. On the end away from the seal, moreover, leakages may occur as well, due to pump housing deformations depending on operating pressure.

The German utility patent 84 07 367 shows displacement elements (FIG. 1, part 17, or FIG. 1, part 16) which, viewed axially, are attached to the displacement ring (14 or 20) by way of two retaining rings (33, 34 or 26, 27).

The German patent publication 24 30 119 shows a radial seal (grooves in the displacement ring) between displacement ring and retaining ring (FIG. 1).

The problem underlying the invention is to provide a hydrostatic displacement machine where, despite close tolerances, the necessary tightness is achievable between the radially outer and radially inner areas.

SUMMARY OF THE INVENTION

This problem is solved by the features of the present invention. A hydrostatic displacement machine, for instance a radial piston machine or a vane cell machine, is provided in a revolving cylinder block with several displacement elements which are movable in a guideway and whose radial position during the rotation of the cylinder block is determined by a nonrotating displacement ring. Resting in a housing, the displacement ring is movable transverse to the axis of rotation of the cylinder block by means of diametrically arranged adjustment pistons, so that the space (eccentricity "e") between the axis of the displacement ring and the axis of rotation of the cylinder block, and thus the stroke of the displacement elements is variable. Situated at least predominantly radially outside the displacement ring, the (outer) area of the housing interior is relative to the (inner) area of the housing interior, which at least predominantly is situated radially within the displacement ring sealed in such a way that within the radially outer area a pressure will build up which ranges slightly above atmospheric pressure. Only the radially inner area of the housing interior is connected to a low-pressure area [leakage oil line, suction channel] while the radially outer area of the housing interior is connected to a pressure supply (line 33). The displacement elements, viewed axially, are retained on the displacement ring by two retaining rings, with the retaining rings featuring relative to the displacement ring a radial seal (O-ring), and the axial seal of the retaining rings being effected in standstill, relative to the housing or housing lid, by way of spring elements, and during the pumping operation, by a contact force which is indirectly dependent on the operating pressure.

BRIEF DESCRIPTION OF THE DRAWINGS

The invention will be more fully explained hereafter with the aid of the drawing, in which.

DESCRIPTION OF THE PREFERRED EMBODIMENTS

Figure 1:
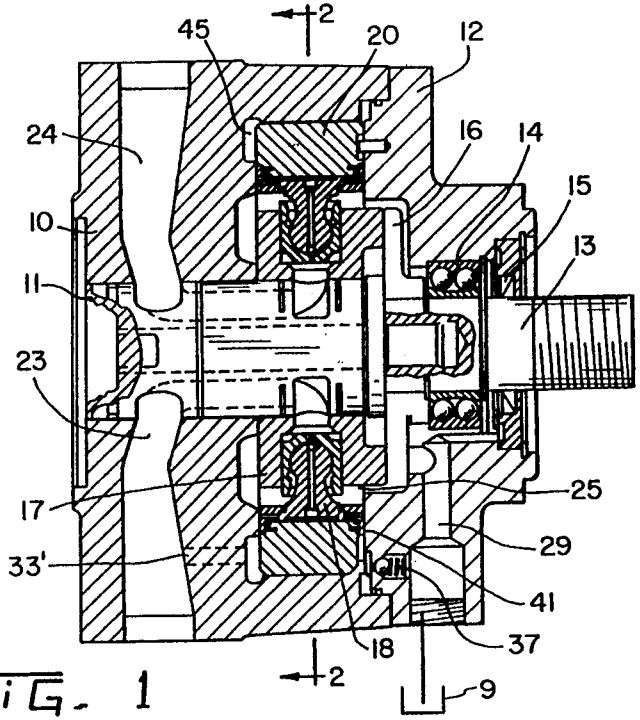
FIG. 1 illustrates a radial piston pump in longitudinal section.
Figure 2:
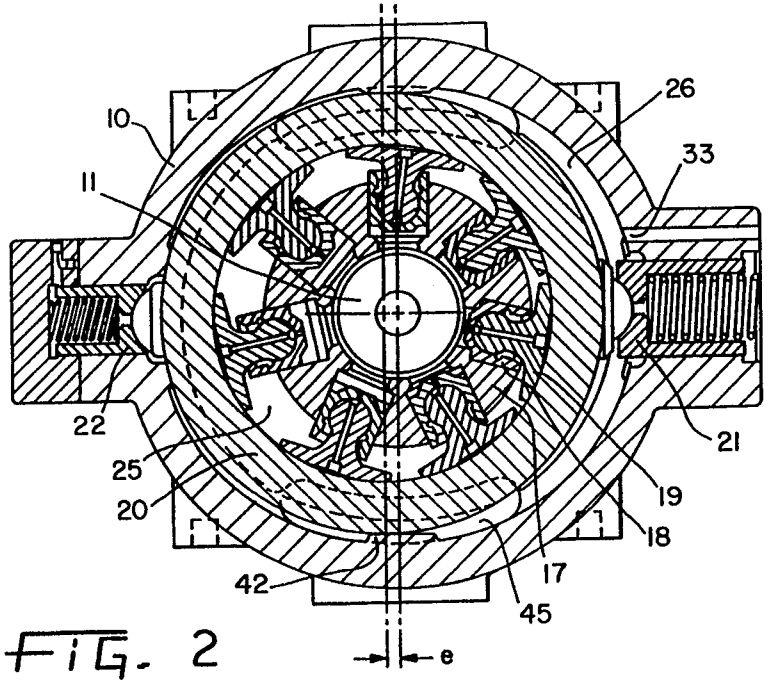
FIG. 2 illustrates the radial piston pump according to FIG. 1 in cross section, along line II—II.

FIG. 1 and 2 illustrate the details and mechanical elements of the illustrated radial piston machine (for instance radial piston pump).

A housing 10 into which a fixed control pin 11 is inserted is sealed by a housing lid 12. Mounted in this lid is a drive shaft 13. Refer also to antifriction bearing 14 and drive shaft seal 15. The drive shaft 13 is by means of a clutch 16 hooked to a cylinder block 17 which, in turn, is rotatably mounted on the control pin 11. Contained in the cylinder block 17, in a spider type arrangement, are a plurality of pistons 18, shown in the embodiment of FIG. 2 as seven pistons. Each of these pistons 18, in turn, is hinged to a piston shoe 19. These assemblies comprised of piston 18 and piston shoe 19 form so-called displacement elements by way of whose revolution the pumping action proper is effected.

Arranged in the housing 10 is a displacement ring 20 which relative to the control pin 11 assumes an eccentric position (compare eccentricity "e"). As the cylinder block 17 rotates, the piston shoes 19 slide along the inner shell surface of said displacement ring 20. The magnitude of the eccentricity "e" between the control pin 11 and the displacement ring 20 is variable, by shifting the displacement ring 20 with the aid of adjustment pistons 21 and 22. Adjustment pistons 21,22 are adjusted according to the demanded pump output, by way of pressure action exerted by means of fluid.

A low-pressure channel 23 and a high-pressure channel 24 extend through the housing 10 and through the control pin 11.

The area 25 of the housing interior radially within the displacement ring 20, includes rotating drive shaft 13, antifriction bearing 14, clutch 16, cylinder block 17 and piston 18 with the piston shoe 19, and communicates by way of a leakage channel 29 with a low-pressure area, for instance with a—symbolically illustrated—pressureless oil tank 9. Thus, a pressure adjusting itself between 0 and 1 bar prevails in this radially inner area 25.

According to the prior radial piston pump, the area 26 of the housing interior contained radially outside the displacement ring 20 is sealed relative to the remaining housing interior, i.e., from the radially inner area 25, in that in one of the end faces of the displacement ring 20 there is an annular groove provided in which an axially movable ring seal is fitted. The displacement ring and the ring seal are spread apart in axial direction with the aid of at least one elastic element (for instance an O-ring). The displacement ring 20, therefore, bears with its one end face always, in sealing fashion, on the surface 40 of the housing 10, while on the opposite end face of the displacement ring 20 the ring seal bears in sealing fashion constantly on the surface 41 of the housing lid 12. It is essential here that a "medium" pressure of about 2 to 4 bars builds up in the radially outer area 26 of the interior, which can come about, e.g., in that leakage fluid penetrates out of a pressure space into the outer area 26, along the adjustment piston 21. The outer area 26, as a further design feature, communicates by way of a channel 33 with a selective pressure supply, so that the buildup of the "medium" pressure in the said area 26 can take place as quickly as possible.

Basically, it is suitable to always maintain a certain pressure difference between the radially outer area 26 and the pressure in the radially inner area 25. To maintain this pressure difference, of for instance 2 to 4 bars, the outer area 26 connects via bores with the leakage oil channel 29. In addition, as illustrated in FIG. 1, a check valve 37 is arranged in the connection between the outer area 26 and the leakage oil channel 29, which check valve opens only if the said pressure difference exceeds the desired value. Instead of the check valve 37, any other suitable pressure valve, for instance a pressure relief valve, may be provided.

The housing 10 features on its inside in known fashion two guide surfaces 42 which provide guidance to the displacement ring 20. This guide surface 42 subdivides the radially outer area 26 of the housing interior in two chambers which, however, are interconnected via channels 45. In the illustrated example, the connecting channels 45 are machined into the housing 10; similar connecting channels could be provided, however, also in the displacement ring 20.

Also illustrated in FIG. 1, by dash-dot lines, is a connecting channel 33' extending from the low-pressure channel 23 to one of the connecting channels 45. This arrangement should be regarded as an alternative to the aforementioned channel 33 (refer to FIG. 2) and applies when in the low-pressure channel 23 a "medium" fluid pressure prevails, which now propagates into the area 26 of the housing interior situated outside the displacement ring.

The radial piston pump depicted and described so far pertains to the prior art. The object of the present invention relates to the seal between the inner and outer areas 25, 26, based as such on the displacement ring 20.

Figure 3:
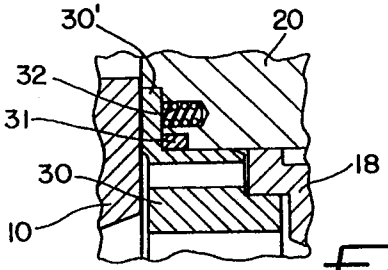
FIG. 3 illustrates a section of the radial piston pump according to FIG. 1, for detail illustration of the axial seal between displacement ring and housing.

The inventional conception, or design, regarding the improved seal over the prior art, is illustrated in FIG. 3, which shows a section of the longitudinal section relative to FIG. 1. In this respect it should be noted that—different from the prior art—a seal is integrated between the inner area 25 and the outer area 26 on both ends of the displacement ring 20. That is, the seal illustrated with the aid of FIG. 3, between the displacement ring 20 and the housing 10, is provided in mirror-inverted fashion equally between the displacement ring 20 and the housing lid 12.

Consequently, a basic consideration is that in addition to the displacement ring 20, which separates the inner area 25 and the outer area 26 from each other, there is on both ends of the displacement ring 20 a flange type, so-called retaining ring 30 each (reference 30') provided, which two retaining rings—relative to the displacement ring 20—can be spread apart axially in relation to each other. Viewed in terms of design, the seal by means of the retaining rings 30 is fashioned as follows: the displacement ring 20 features on both ends a first recess each into which the retaining rings 30 are fitted by way of their flange type projection 30'. Moreover, the displacement ring 20 features a second recess each, so that between the displacement ring 20 and the retaining ring 30 there is a radial space 31 created into which an elastic seal is inserted, for instance in the form of an O-ring.

Due to this specific design., the deformation of the O-ring in the radial space 31 occurs now radially and no longer—as with the prior art—axially, so that in the manufacture there is no longer any excessive expense required in view of the tolerances of the longitudinal dimensions. The installation of two retaining rings 30, and thus two sealing washers, has the advantage that not only the longitudinal tolerances can be balanced, but that also angular deviations between the displacement ring 20 and the housing 10, or housing lid 12, as well as angular variations of the displacement ring 20 due to load-dependent deformations can be compensated for. The retaining rings are needed in any event for the basic function of the pump; they hold the pistons 18 on the running surface of the displacement ring 20.

The above functional description presupposes that the pump is operating. In this case—analogous to the prior art—the inner area 25 and outer area 26 are being sealed relative to each other in accordance with the pressure difference establishing itself between both. In order to assure the axial hold-down of the retaining rings 30, i.e., of the sealing washers, at any operating condition, including also at the start of the pumping operation, spring elements 32 are additionally installed in the displacement ring, opposite the flange type projection 30' of the retaining rings 30.

Figure 4:
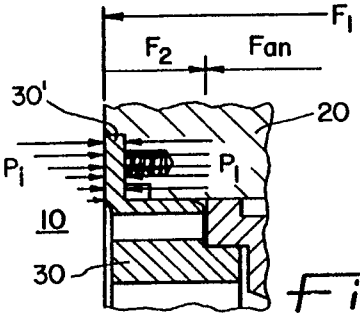
FIG. 4 illustrates the section relative to FIG. 3 for illustration of the forces acting on the retaining ring.

The inventional configuration will hereafter be illustrated once more with the aid of FIG. 4, by way of a review of the pressure, or force, conditions which are effective in the area of the retaining ring 30. In FIG. 4, the displacement ring 20 with the retaining ring 30 representing the seal are illustrated as a pairing of elements opposite to the housing 10.

The specific pairing of displacement ring 20/retaining ring 30 is so designed, or conceived, that the slightly elevated interior pressure $P_1$ (in the space above the displacement ring 20) is fully effective on the retaining ring 30 up to the seal (O-ring) in the radial space 31, while on the side of the retaining ring 30 facing the housing 10 the conjugated pressure Pi diminishes down to the level of the interior space. The appropriate contact forces F1, F2 thus produce a resultant defined contact force Fan for forcing the retaining ring 30 on the housing 10 (or housing lid 12).

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a hydrostatic displacement machine, comprising a plurality of displacement elements in a revolving cylinder block, said displacement elements being movable in a guideway and having a radial position determinable by a nonrotating displacement ring during the rotation of the cylinder block; wherein the displacement ring rests in a housing and is movable transverse to the axis of rotation of the cylinder block by means of diametrically arranged adjustment pistons so that an eccentric space is formed between the axis of the displacement ring and the axis of rotation of the cylinder block, and thus the stroke of the displacement elements is variable; an outer area situated in the housing at least predominantly radially outside the displacement ring is sealed relative to an inner area situated in the housing at least predominantly radially inside the displacement ring such that within the radially outer area a pressure will build up, which pressure ranges slightly above atmospheric pressure; only the radially inner area of the housing interior is connected to a low pressure area, said radially outer area being connected to a pressure supply, wherein the improvement comprises:

said displacement elements, viewed in the axial direction, being retained on said displacement ring by two retaining rings, said retaining rings featuring, relative to the displacement ring, a radial seal; the retaining rings having an axial seal being effected in standstill relative to the housing by way of spring elements, and during pumping operation of the machine, by a contact force which is indirectly dependent on the operating pressure.

* * * * *